US009111529B2

(12) United States Patent
Amadu et al.

(10) Patent No.: US 9,111,529 B2
(45) Date of Patent: Aug. 18, 2015

(54) METHOD FOR ENCODING/DECODING AN IMPROVED STEREO DIGITAL STREAM AND ASSOCIATED ENCODING/DECODING DEVICE

(75) Inventors: Frédéric Amadu, Chelles (FR); Thomas Esnault, Paris (FR)

(73) Assignee: ARKAMYS, Paris (FR)

( * ) Notice: Subject to any disclaimer, the term of this patent is extended or adjusted under 35 U.S.C. 154(b) by 470 days.

(21) Appl. No.: 13/518,993

(22) PCT Filed: Dec. 10, 2010

(86) PCT No.: PCT/FR2010/052671

§ 371 (c)(1),
(2), (4) Date: Jun. 25, 2012

(87) PCT Pub. No.: WO2011/086253

PCT Pub. Date: Jul. 21, 2011

(65) Prior Publication Data

US 2012/0275608 A1 Nov. 1, 2012

(30) Foreign Application Priority Data

Dec. 23, 2009 (FR) ..... 09 59547

(51) Int. Cl.
*H04R 5/00* (2006.01)
*G10L 19/008* (2013.01)
(Continued)

(52) U.S. Cl.
CPC ..... *G10L 19/008* (2013.01); *H04S 1/007* (2013.01); *H04S 5/00* (2013.01); *H04S 2420/03* (2013.01); *H04S 2420/07* (2013.01)

(58) Field of Classification Search
CPC ..... G10L 19/008; G10L 19/24; G10L 19/02; G10L 21/0208; G10L 19/167; G10L 19/00; G10L 19/005; G10L 19/04; G10L 19/0017; G10L 19/18; G10L 25/18; G10L 21/0205; H04R 3/005; H04R 3/12; H04R 25/407; H04H 60/58; G11B 2020/00057
USPC ..... 381/1, 2, 10, 11, 12, 17, 19, 20, 21, 22, 381/23, 26, 27, 28, 61, 74, 80, 81, 86, 309; 700/94
See application file for complete search history.

(56) References Cited

U.S. PATENT DOCUMENTS 4,991,218 A * 2/1991 Kramer ..... 381/61
6,895,093 B1 5/2005 Ali
2010/0303245 A1* 12/2010 Vickers ..... 381/17

FOREIGN PATENT DOCUMENTS

WO WO 2006/048227 A1 5/2006
WO WO 2006/132857 A2 12/2006

OTHER PUBLICATIONS

Engdegard et al "Synthetic Ambience in Parametric Stereo Coding", AES 116th Convention, May 8-11, 2004, p. 1-12, Berlin, Germany.*
(Continued)

*Primary Examiner* — Leshui Zhang
(74) *Attorney, Agent, or Firm* — IM IP Law PLLC; C. Andrew Im

(57) ABSTRACT

A method for encoding and decoding a digital audio signal composed of an original right-hand signal ($S_{DO}$) and an original left-hand signal ($S_{GO}$). The method combines the original right-hand signal ($S_{DO}$) and the original left-hand signal ($S_{GO}$) to obtain a single combined signal ($S_C$), encodes the combined signal ($S_C$) using a standard encoder to obtain a compressed combined signal ($S_{CC}$), and decodes the compressed combined signal ($S_{CC}$) using a standard decoder (8) to obtain a decompressed combined signal ($S_{CD}$). After decoding, the method generates a reconstructed right-hand signal ($S_{DR}$) and a reconstructed left-hand signal ($S_{GR}$) from the decompressed combined signal ($S_{CD}$), which are de-correlated from each other. Also, a treble-generating module enables the high-frequency component ($S_{HF}$) of the right-hand ($S_{DR}$) or left-hand ($S_{GR}$) signals to be recreated, which signals had been deleted as a result of the compression.

14 Claims, 3 Drawing Sheets

(51) Int. Cl.
*H04S 1/00* (2006.01)
*H04S 5/00* (2006.01)

(56) References Cited

OTHER PUBLICATIONS

Kim et al "Enhanced Stereo Coding with Phase Parameters for MPEG Unified Speech and Audio Coding", AES 127th Convention, Oct. 9-12, 2009, p. 1-7, New York City, USA.*

"Information Technology-Coding of Moving Pictures and Associated Audio for Digital Storage Media at up to about 1.5 Mbit/s, Part 3: Audio", International Standard ISO/ICE, No. 11172-03, Aug. 1, 1993, pp. 1-158.

Jean-Marc Valin, "Perceptually-Motivated Nonlinear Channel Decorrelation for Stereo Acoustic Echo Cancellation", Hands-free Speech Communication and Microphone Arrays, May 6, 2008, pp. 188-191, IEEE, Piscataway, NJ, USA.

Engdegard, Purnhagen, Roden and Liljeryd, "Synthetic Ambience in Parametric Stereo Coding," Audio Engineering Society, May 8-11, 2004, AES 116th Convention, Berlin, Germany.

* cited by examiner

METHOD FOR ENCODING/DECODING AN IMPROVED STEREO DIGITAL STREAM AND ASSOCIATED ENCODING/DECODING DEVICE

RELATED APPLICATIONS

This application is a §371 application from PCT/FR2010/052671 filed Dec. 10, 2010, which claims priority from French Patent Application No. 09 59547 filed Dec. 23, 2009, each of which is incorporated herein by reference in its entirety.

TECHNICAL FILED OF THE INVENTION

The invention relates to a method for encoding/decoding a digital stereo sound stream as well as a device made up of an encoder and an associated decoder. The purpose of the invention is in particular to improve a standard system of the type encoder/decoder (codec) making it possible to encode and decode a digital stereo/audio stream.

The invention finds an application particularly advantageous in the field of codecs for the compression of stereo/audio signals such as for example codecs of the type MP3. However, the invention could also be used with any type of codec adapted to the encoding and the decoding of two digital sound signals.

BACKGROUND OF THE INVENTION

Digital codecs of the type MP3 or other formed by a standard encoder makes it possible to encode, according to a known encoding protocol, digital stereo sound signals for example in WAVE format in order to transform said digital stereo sound signals into encoded stereo signals; a standard decoder is also known which makes it possible to decode, according to a known decoding protocol, encoded stereo signals in order to transform them into digital stereo signals for example in WAVE format. In general, encoding consists in compressing stereo signals, while decoding consists in decompressing compressed stereo signals.

The problem is that the transmission channel available for encoding is generally limited to N kbits/s (N generally being equal to 64 or 128). However when a stereo signal formed of two audio channels: a right sound channel and a left sound channel, is encoded according to the characteristics of the codecs used, it can be necessary to encode approximately each audio channel of the signal at a transfer rate of N/2 kbits/s.

OBJECT AND SUMMARY OF THE INVENTION

The invention makes it possible to increase the quality of the final stereo signal without increasing the transfer rate in the transmission channel; or to preserve the quality of the final stereo signal by reducing the transfer rate in the transmission channel.

For this purpose, the device according to the invention comprises a so-called pre-processing module associated with the standard encoder acting before the encoding process, which combines the stereo signals in order to transform said stereo signals into a single combined signal. The invention also comprises a post-processing module associated with the decoder acting after decoding the compressed signal, which makes it possible to generate the two audio signals from the single combined signal generated by the pre-processing module. The function of this post-processing module is to generate two sound signals (right and left) decorrelated relative to one another from the decompressed combined signal.

Thus, in the invention, there is only one signal to be encoded (the single combined signal) instead of the two right and left signals in the traditional methods. That makes it possible either to less compress the combined signal in order to increase the quality of the final signal, or to decrease the transfer rate in the transmission channel while having the same quality as with the existing encoding methods.

Preferably, in order to enable the decoder to detect whether it is question of a stream encoded by the method according to the invention or a standard stream not encoded by the invention, a meta-datum is added into the data frame encoded by the encoder, which indicates whether the method according to the invention is activated or not. The site of this meta-datum in the frame encoded by the encoder can vary according to the standard encoding used.

The invention thus relates to a method for encoding and decoding a digital audio signal composed of an original right sound signal and of an original left sound signal, wherein said method comprises the following steps:

- before encoding, the original right sound signal and the original left sound signal are combined in order to obtain a single combined signal,
- the combined signal is encoded by means of a standard encoder in order to obtain a compressed combined signal,
- the compressed combined signal is decoded by means of a standard decoder in order to obtain a decompressed combined signal, and
- after decoding, a restored right sound signal and a restored left sound signal decorrelated relative to one another corresponding respectively to the original right sound signal and the original left sound signal are generated from the decompressed combined signal.

According to an implementation, in order to combine the right and left original sound signals into a single combined signal, a point-to-point weighted sum of the samples of the original right sound signal and the original left sound signal are carried out in the temporal field.

According to an embodiment, in order to generate from the decompressed combined signal the restored right and left sound signals, the decompressed combined signal is applied to the input of a first and a second elementary block, the output signal for these blocks corresponding respectively to the restored right electric sound signal and to the restored left electric sound signal, the output signal for each block being the combination of the input signal for the block weighted by a first gain, and of the combination of the output signal for the block weighted by a second gain and of the input signals for the block delayed by a delay line.

According to an embodiment:

for the first elementary block, $$s_1(n)=e_1(n)\cdot g_1+s_1(n-D1)\cdot g_2+e_1(n-D1)$$

$e_1$ being the input signal for the first block corresponding to the decompressed combined signal, $s_1$ being the output signal for the first block corresponding to one of the restored sound signals (right or left), $g_1$, $g_2$ being respectively the values of the first gain and the second gain for the first block, n being the $n^{th}$ harmonic sample, D1 being the value of the number of delay samples introduced by the delay line, and for the second elementary block:

$$s_2(n)=e_2(n)\cdot g_3+s_2(n-D2)\cdot g_4+e_2(n-D2)$$

$e_2$ being the input signal for the second block corresponding to the decompressed combined signal, $s_2$ being the output signal for the second block corresponding to the other restored sound signal (right if $s_1$ corresponds to the left one or left if $s_1$ corresponds to the right one), $g_3$, $g_4$ being respectively the values of the first gain and the second gain for the second block, n being the $n^{th}$ harmonic sample, D2 being the value of the number of delay samples introduced by the delay line.

According to an embodiment, the gain values inside a block are opposite one another, the value of the first gain being opposite the value of the second gain.

According to an embodiment, the gain values of the first block are opposite the gain values of the second block, the value of the first gain of the first block being opposite the value of the first gain of the second block; while the value of the second gain of the first block is opposite the value of the second gain of the second block.

According to an embodiment, the gain values of the first and second elementary block have the same absolute value.

According to an embodiment, the first gain of the first block and the second gain of the second block are equal to g; while the second gain of the first block and the first gain of the second block are equal to −g.

According to an embodiment, the delay introduced by the line of the first block and the delay introduced by the line of the second block is equal to one another.

According to an embodiment, the decompressed combined signal is first filtered by means of a high-pass filter and only the filtered high frequency part is applied to the input of the elementary blocks.

According to an embodiment, the low frequency part of the decompressed combined signal is filtered, the thus-filtered low frequency part is delayed with a third delay by means of a third delay line, and the thus-delayed low frequency part is added to the output signals of the elementary blocks obtained from the high frequency part in order to obtain the restored right sound signal and the restored left sound signal.

According to an embodiment, the output signals of each elementary block by means of parametric filtering cells is filtered in gain and in phase in order to modify the sound perception of these output signals.

According to an embodiment, to enable the decoder to detect whether it is question of an encoded stream formed of a combined signal or a standard stream, a meta-datum is added into the data frame encoded by the encoder, which indicates whether the step of combining the original right and left signals into a single combined signal is activated or not.

According to an embodiment, for each restored right and left sound signal primarily formed of a low frequency component lower than a cut-off frequency, the highest frequency part of the restored sound signal is isolated by means of a first filter of the band-pass type, the isolated part is duplicated with regard to the frequency by means of a nonlinear processor which generates the high frequency harmonics of the isolated signal in order to obtain a duplicated signal, a second band-pass filter is applied to the duplicated signal in order to obtain a high frequency component, the thus-generated high frequency component is combined with the restored sound signal beforehand delayed by a delay cell, and an increased restored signal comprising a low frequency component and a regenerated high frequency component is obtained, upper and lower limits of the band-pass filter depending on the compression ratio applied by the method.

The invention moreover relates to a digital stream encoder used with the decoder according to the invention for the implementation of the method for encoding and decoding a digital audio signal composed of an original right sound signal and of an original left sound signal according to the invention, wherein said digital stream encoder comprises:

a pre-processing means able to combine, before encoding, the original right sound signal and the original left sound signal in order to obtain a single combined signal, and a standard encoder able to encode the combined signal in order to obtain a compressed combined digital signal.

The invention also relates to a digital stream decoder by means of the encoder according to the invention for the implementation of the method for encoding and decoding a digital audio signal composed of an original right sound signal and of an original left sound signal according to the invention, wherein said digital stream decoder comprises:

a standard decoder able to decode a single compressed combined signal in order to obtain a decompressed combined signal, and a post-processing module able to generate, after decoding, from the decompressed combined signal, a restored right sound signal and a restored left sound signal decorrelated relative to one another corresponding respectively to the original right sound signal and the original left sound signal.

According to an embodiment, said decoder moreover comprises a module for generating treble frequencies including:

a first filter of the band-pass type for isolating the highest frequency part of the restored sound signal, a nonlinear processor which generates the high frequency harmonics of the isolated signal in order to duplicate the isolated part with regard to the frequency so as to obtain a duplicated signal, a second band-pass filter applied to the duplicated signal so as to obtain a high frequency component, means for combining the thus-generated high frequency component with the restored sound signal beforehand delayed by a delay cell, so as to obtain an increased restored signal comprising a low frequency component and a regenerated high frequency component.

According to an embodiment, the upper and lower limits of the band-pass filter depend on the compression ratio applied by the method.

BRIEF DESCRIPTION OF THE DRAWINGS

The invention will be better understood when reading the following description and examining the annexed figures. These figures are given only as an illustration but by no means a restriction of the invention. They show.

DETAILED DESCRIPTION OF THE EMBODIMENTS

Identical elements have the same reference throughout the figures.

Figure 1:
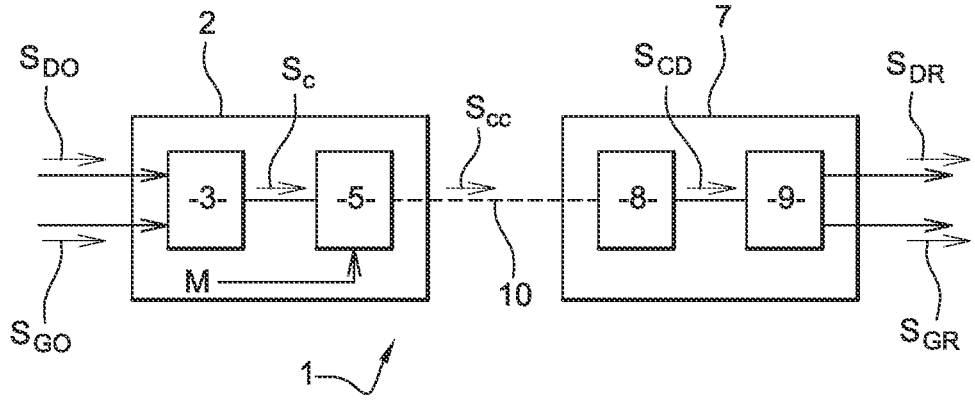
FIG. 1: a schematic representation of an encoding/decoding device according to the invention.

FIG. 1 shows an encoding/decoding device 1 according to the invention comprising an encoder 2 according to the invention formed by a pre-processing module 3 associated with a standard encoder 5. The encoder 5 can be for example a digital audio encoder of the mp3 type such as for example the encoder LAME or an encoder for encoding sound streams for digital television.

In addition, the device 1 according to the invention comprises a decoder 7 according to the invention formed by a standard decoder 8 and an associated post-processing module 9. The decoder 8 could be for example a decoder of the MP3 type integrated into a digital music player or an audio decoder integrated into a digital television decoder (set top box).

Figure 2:
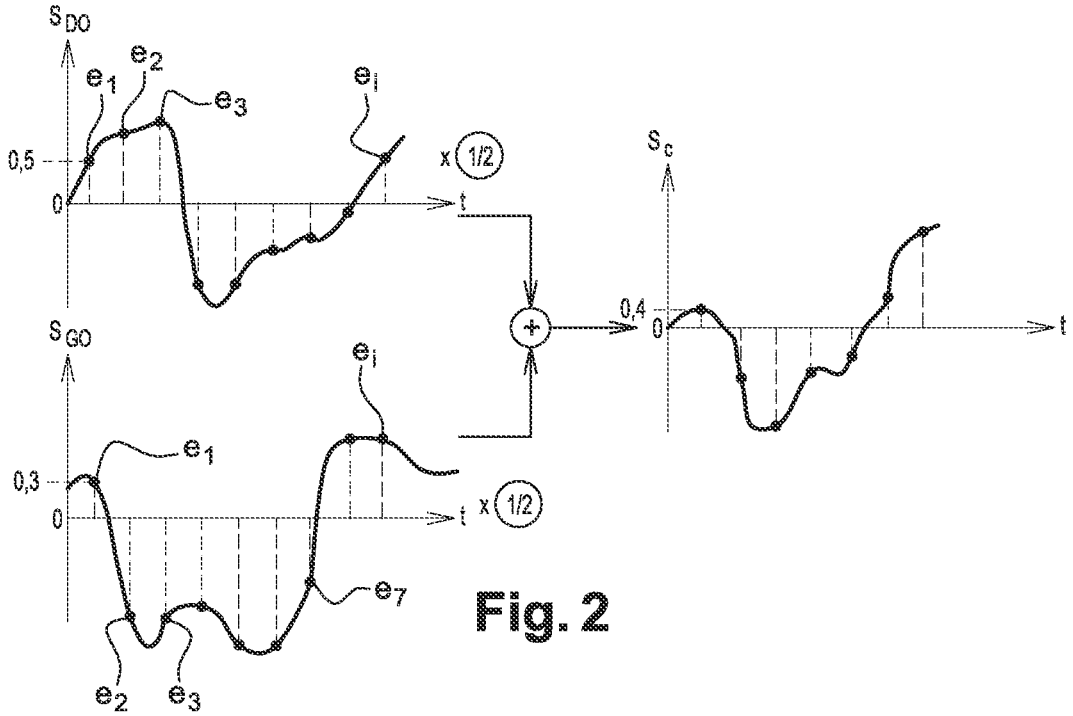
FIG. 2: a graphical representation of the original stereo signals and the signal resulting from a nonrestrictive particular combination of these signals by the pre-processing module.

When operating, a stereo signal formed by an original right sound signal $S_{DO}$ and an original left sound signal $S_{GO}$ are applied to the input of the pre-processing module 3. The original right $S_{DO}$ and left $S_{GO}$ sound signals are sampled and quantified signals. As shown in FIG. 2, the module 3 carries out the combination of the signal $S_{DO}$ and the signal $S_{GO}$, so as to output a single combined signal $S_c$. In an example, the signals $S_{DO}$ and $S_{GO}$ are weighted with a coefficient of 0.5 and are then sample-to-sample added for generating $S_c$.

The combined signal $S_c$ is applied to the input of the encoder 5 which compresses the signal $S_c$ according to a known compression protocol so as to obtain a compressed combined signal $S_{CC}$. This signal $S_{CC}$ could be for example transmitted on any type of wired media, radio, or other or even saved on a digital storage medium such as for example a CD-ROM or a memory of the USB type.

Since it is enough to encode the combined signal $S_C$ whereas the two signals (right and left) of the stereo signal need to be encoded in the existing methods, it is clear that the method according to the invention makes it possible to limit the stream in the available encoding channel 10, or then to reduce the compression ratio for improving the final sound rendering if the same transfer rate as in the existing methods is kept.

The compressed combined signal $S_{CC}$ is applied to the input of the decoder 8 which decompresses it, according to a known decompression protocol, so as to obtain a decompressed combined signal $S_{CD}$.

Figure 3:
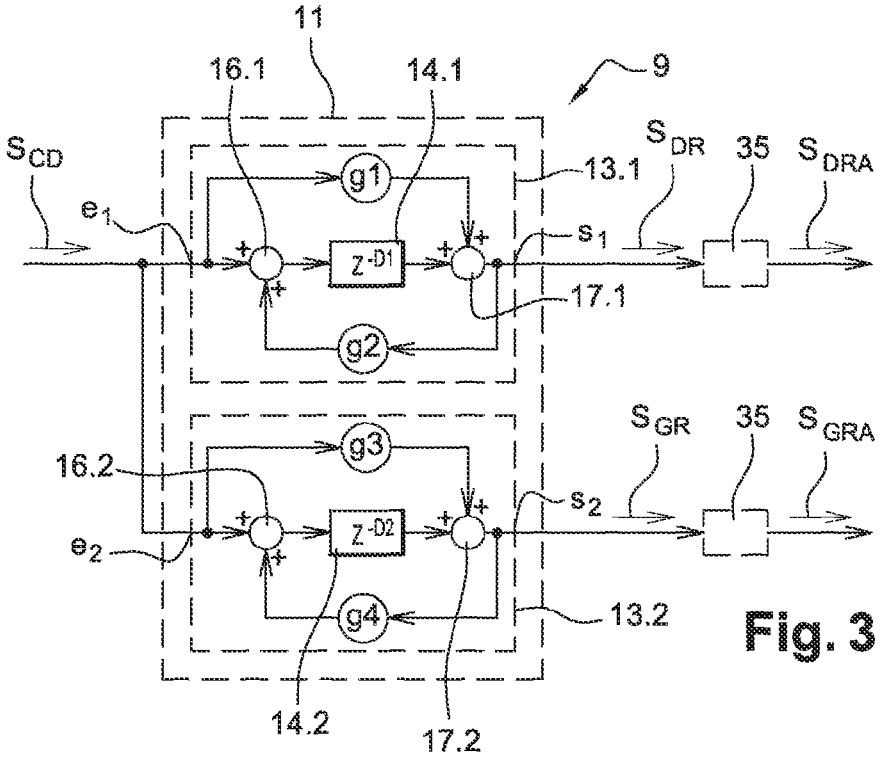
FIG. 3: a schematic representation of the blocks forming the post-processing module according to the invention.

The signal $S_{CD}$ is then applied to the input of the post-processing module 9 comprising, as shown in FIG. 3, a decorrelating module 11 for the signal which makes it possible to generate, from the signal $S_{CD}$, two signals decorrelated relative to one another: the restored right sound signal $S_{DR}$ and the restored left sound signal $S_{GR}$ corresponding to the original right and left sound signal $S_{DO}$ and $S_{GO}$.

For this purpose, the decorrelating module 11 is made of two elementary blocks 13.1-13.2 to the input of which the decompressed combined signal $S_{CD}$ is applied, the output of these blocks 13.1, 13.2 corresponding respectively to the restored right sound signal $S_{DR}$ and to the restored left sound signal $S_{GR}$. The output signal $s_1$ (resp. $s_2$) of each block 13.1 (resp. 13.2) depends on the combination of the input signal $e_1$ (resp. $e_2$) for the block weighted with a first gain $g_1$ (resp. $g_3$), and of the combination of the input signals $e_1$ (resp. $e_2$) and of the output signal $s_1$ (resp. $s_2$) for the block weighted with a second gain $g_2$ (resp. $g_4$), delayed by a delay line 14.1 (resp. 14.2).

According to an embodiment, for each elementary block 13.1, 13.2, the input signal $e_1$, $e_2$ is applied to the input of a first adder 16.1, 16.2 and is applied to an input of a second adder 17.1, 17.2 after being multiplied by the first gain $g_1$, $g_3$. The output signal $s_1$, $s_2$ for the block is applied to another input of the first adder 16.1, 16.2 after being multiplied by the second gain $g_2$, $g_4$, the output signal of the first adder 16.1, 16.2 being applied to the input of the delay line 14.1, 14.2. The output signal for the delay line 14.1, 14.2 is applied to another input of the second adder 17.1, 17.2, the output signal for this second adder 17.1, 17.2 corresponding to the output signal $s_1$, $s_2$ of for block and thus to the restored right $S_{DR}$ or left $S_{GR}$ sound signal.

Thus, for the first elementary block 13.1:

$$s_1(n)=e_1(n)\cdot g_1+s_1(n-D1)\cdot g_2+e_1(n-D1)$$

$e_1$ being the input signal for the first block 13.1 corresponding to the decompressed combined signal, $s_1$ being the output signal for the first block 13.1 corresponding to one of the restored sound signals (right or left), $g_1$, $g_2$ being respectively the values of the first gain and the second gain of the first block 13.1, n being the $n^{th}$ harmonic sample, D1 being the value of the number of delay samples introduced by the delay line 14.1.

For the second elementary block 13.2:

$$s_2(n)=e_2(n)\cdot g_3+s_2(n-D2)\cdot g_4+e_2(n-D2)$$

$e_2$ being the input signal for the second block 13.2 corresponding to the decompressed combined signal, $s_2$ being the output signal for the second block 13.2 corresponding to the other restored sound signal (right if $s_1$ corresponds to the left one or left if $s_1$ corresponds to the right one), $g_3$, $g_4$ being respectively the values of the first gain and the second gain of the second block 13.2, n being the $n^{th}$ harmonic sample, D2 being the value of the number of delay samples introduced by the delay line 14.2.

Preferably, inside the same block 13.1 (resp. 13.2), the first gain $g_1$ (resp. $g_3$) and the second gain $g_2$ (resp. $g_4$) have values opposite one another. Each block 13.1, 13.2 then behaves as a filter of the all-pass type which does not modify the gain of the input signal $e_1$, $e_2$ but only the phase thereof.

Moreover, the gains $g_1$, $g_2$ of the first block 13.1 and the gains $g_3$, $g_4$ of the second block 13.2 have preferably values opposite one another. Thus, the value of the first gain $g_1$ of the first block 13.1 is opposite the value of the first gain $g_3$ of the second block 13.2; while the value of the second gain $g_2$ of the first block 13.1 is opposite the value of the second gain $g_4$ of the second block 13.2.

Gains for the first 13.1 and the second 13.2 block which have an identical absolute value g will also preferably be chosen. Thus, preferably, the first gain $g_1$ of the first block 13.1 and the second gain $g_4$ of the second block 13.2 have a value g; while the second gain $g_2$ of the first block 13.1 and the first gain $g_3$ of the second block 13.2 have a value −g.

Preferably, the delays D1, D2 introduced by the delay line 14.1 of the first elementary block 13.1 and the delay line 14.2 of the second elementary block 13.2 are equal to one another. However, it would be possible to choose delays D1, D2 with different durations In an embodiment example, g=0.4 and delays D1 and D2 of 176 samples each are chosen, such values allowing to obtain a good sound rendering.

Figure 4:
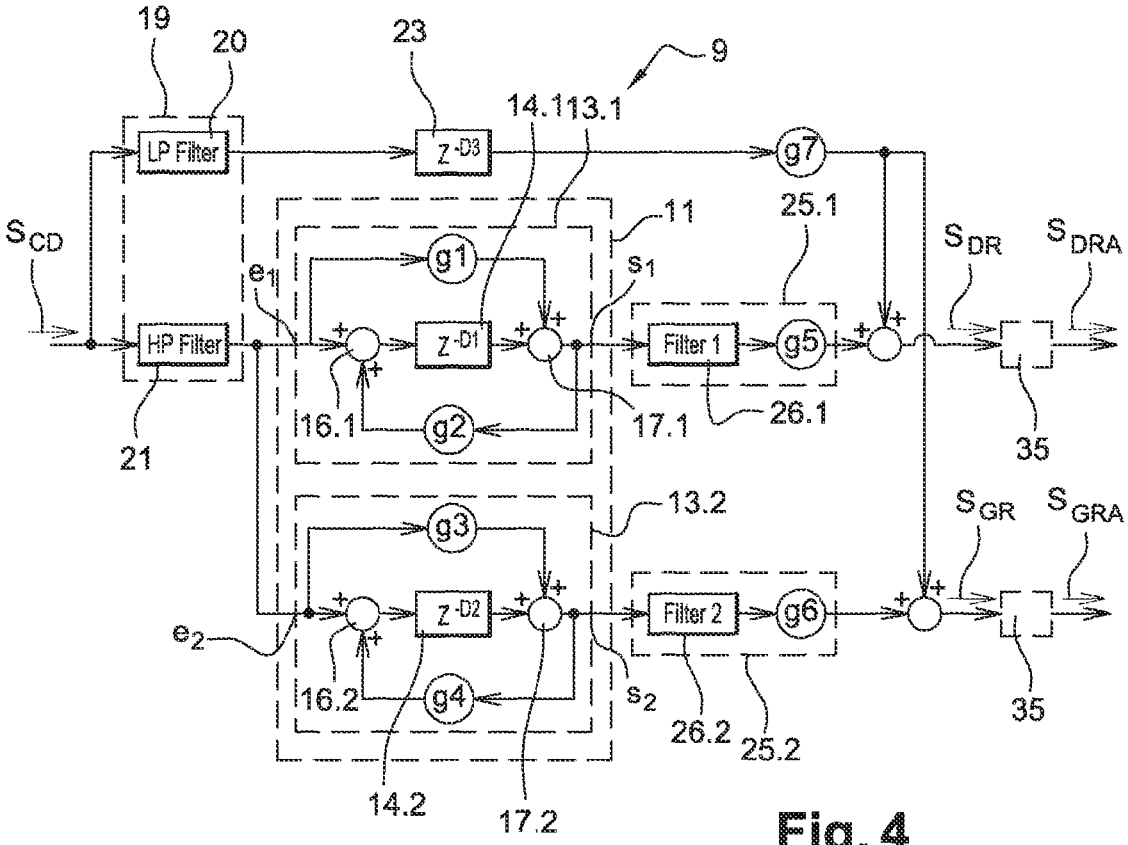
FIG. 4: a schematic representation of the blocks forming the post-processing module in an improvement of the invention.

In an improvement of the invention represented in FIG. 4, a stage 19 made up of two low-pass 20 and high-pass 21 filters allowing to separate the low frequency part from the high frequency part of the decompressed combined signal $S_{CD}$ is used. In this case, only the high frequency part of the signal $S_{CD}$ is applied to the input of the decorrelating module 11. In an example, the cut-off frequencies of the low-pass filter 20 and high-pass filter 21 are about 350 Hz.

The low frequency part of the signal $S_{CD}$ is applied to the input of a third delay line 23 and the thus-delayed low frequency part is added, if need be after weighting with a gain g7, to the output signals $s_1$, $s_2$ of the elementary blocks, so as to obtain restored right $S_{DR}$ and left $S_{GR}$ sound signals with an improved sound rendering. For one realizes that statistically the low frequency signals are very correlated, it is not therefore advisable to decorrelate them by means of the decorrelating module 11, otherwise the general audiophonic perception will not appear natural in the ear. In an example, the delay D3 applied by the third delay line 23 is equal to 176 samples (at a sampling rate of 44.1 KHz).

Moreover, parametric equalization cells 25.1, 25.2 is connected to the output of each elementary block 13.1, 13.2 before addition to the delayed low frequency part. These cells 25.1, 25.2 cause the modification of the perception of the output signals $s_1$, $s_2$ of these blocks 13.1, 13.2 because, even if the signals $s_1$, $s_2$ have substantially identical levels, there are differences in the perception thereof because of the decorrelation relative to one another. Consequently, it can be useful to modify these signals from a perceptive point of view so that the general sound impression is as best as possible.

For this purpose, each equalization cell 25.1, 25.2 comprises a filter 26.1, 26.2 whose gain and phase can be adjusted according to various frequency bands of the signals $s_1$, $s_2$ and a gain g5, g6 which act on all the spectrum of the signals $s_1$, $s_2$. These gain and phase parameters are adapted by sound engineers in particular according to the application considered.

Preferably, in order that the decoder 8 can detect whether it is question of a stream encoded by the method according to the invention or of a standard stream not encoded by the invention, a meta-datum M is added into the data frame encoded by the encoder 5, which indicates whether the method according to the invention is activated or not. This meta-datum M is of the static type, i.e. it will be able for example to take only two different values so that, when the decoder 7 detects in the encoded frame the first value (for example 1) corresponding to the activation of the pre-processing module 3, it activates the post-processing module 9; and when the decoder 7 detects in the encoded frame the second value corresponding to the deactivation of the pre-processing module 3, it inhibits the post-processing module 9 and uses in a traditional way the standard decoder 8 for decoding the stereo signal in the two right and left channels. Indeed, in the case of the deactivation of the module 3, the signals $S_{DO}$ and $S_{GO}$ are directly applied to the input of the standard encoder 5 for a traditional encoding, then transmitted to the decoder 8, then decoded in a traditional way by the decoder 8 in order to obtain a restored left signal $S_{GR}$ and a restored right signal $S_{DR}$.

Figure 5:
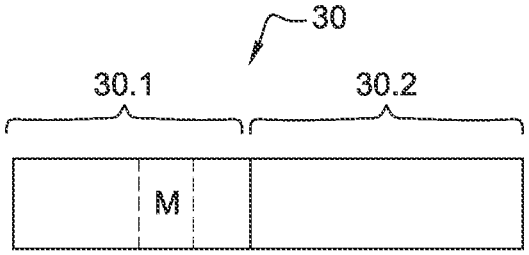
FIG. 5: a schematic representation of a frame encoded by a standard encoder showing a meta-datum introduced by the method according to the invention.

The site of this meta-datum M in the frame 30 encoded by the encoder 5 can vary according to the standard encoding used. FIG. 5 shows a schematic representation of an encoded frame 30 comprising a heading 30.1 in particular indicating the type of encoding used and the length of the frame 30 as well as a data part 30.2 in which the encoded data are packed. The meta-datum M will be introduced into a site of the heading 30.1 left available by the standard encoding protocol.

In an improvement of the invention, an analysis of the correlation between the original right $S_{DO}$ and left $S_{GO}$ sound signals are carried out in definite frequency bands so as to produce a coefficient representative of the correlation in each band.

The calculated correlation coefficients are packed as meta-data into the heading 30.1 of the encoded signal.

Then, the parameters $g_1$, $g_2$, $g_3$, $g_4$, D1, D2 of the elementary blocks 13.1 and 13.2 are adapted according to the received correlation values, so as to decorrelate each range of frequencies differently.

For this purpose, a table stored in a memory gives the correspondence between the parameters of each block 13.1, 13.2 (first gain $g_1$, $g_3$ and second gain $g_2$, $g_4$ and delay D1, D2 of the line 14.1, 14.2) and the received correlation ratios. The decorrelation ratio of the decorrelating module 11 is then modified by selecting in the table the parameters ($g_1$-$g_4$, D1, D2) corresponding to the correlation coefficient received.

In addition, it is known that the upper cut-off frequency $f_C$ of the restored signals depends on the compression ratio T applied by the encoder 5. Indeed, for compression ratios T corresponding to a transfer rate of 128 kbits/s there is a cut at 15 kHz for signals in MP3 encoders; while for compression ratios T corresponding to a transfer rate of 64 kbits/S, there is a cut at 10 kHz for signals. In other words, the higher the compression ratio T is, the more the high frequency component of the signals is reduced.

The invention makes it possible to regenerate the high frequency component of the right $S_{DR}$ or left $S_{GR}$ sound signals which has been suppressed because of the compression. This aspect of the invention is independent of the principle of generation of the two stereo-decompressed sound signals $S_{DR}$ and $S_{GR}$ from only one compressed signal $S_C$.

Figure 6:
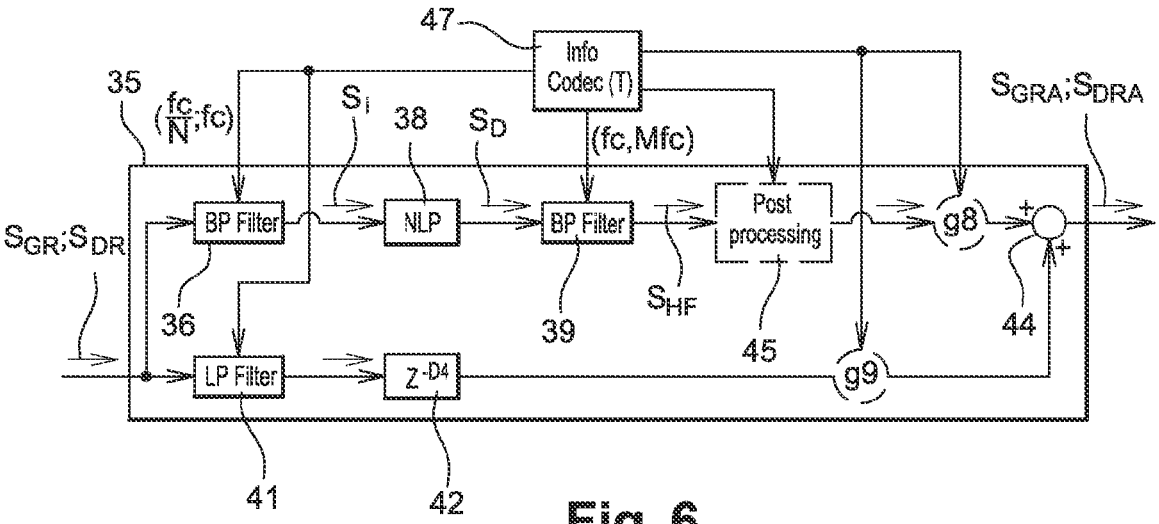
FIG. 6: a schematic representation of a module for generating high frequency components for the decoded stereo signals to be broadcast.
Figure 7A:
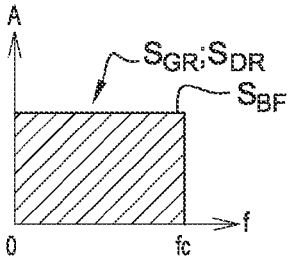
FIGS. 7*a*-7*e*: very schematic representations of the signals that can be observed when using the module for generating high frequency components in FIG. 6.

For this purpose, the restored left $S_{GR}$ and right $S_{DR}$ sound signals, which are substantially formed of a low frequency component $S_{BF}$ lower than the cut-off frequency $f_C$ (see FIG. 7*a*), are each applied to the input of a module 35 for generating treble frequencies shown in details in FIG. 6.

Figure 7B:
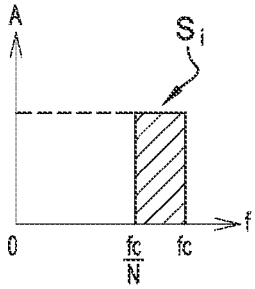

This module 35 comprises a first band-pass filter 36 at the input of which the restored left $S_{GR}$ (resp. right $S_{DR}$) sound signal is applied. This first filters 36 makes it possible to isolate the highest frequency part of the input signal $S_{GR}$ (resp $S_{DR}$) ranging between a lower limit and an upper limit. In an example, the upper limit is equal to the cut-off frequency $f_C$, and the lower limit is equal to $f_C$/N, N preferably being equal to 2 or 4. The isolated part Si of the restored signal obtained at the output of the band-pass filter 36 is shown in FIG. 7*b*.

Figure 7C:
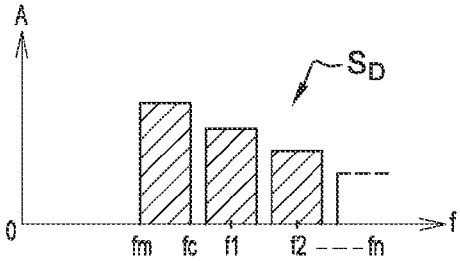

The isolated part Si is then applied to the input of the processor 38 of a nonlinear type which makes it possible to duplicate the isolated signal Si with regard to the frequency by generating the high frequencies harmonics at $f_1$, $f_2$, . . . fn of this signal Si, which makes it possible to fill the frequency spectrum in the zone of high frequencies. The duplicated signal $S_D$ thus obtained at the output of the nonlinear processor 38 is shown in FIG. 7*c*. Preferably, as represented, the harmonics of the signal $S_D$ have an amplitude which decreases as the frequency increases.

Figure 7D:
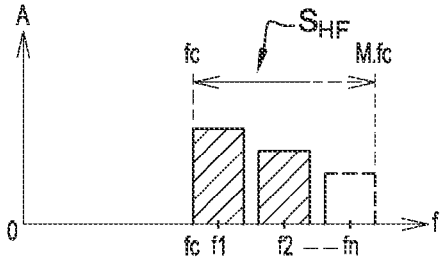
Figure 7E:
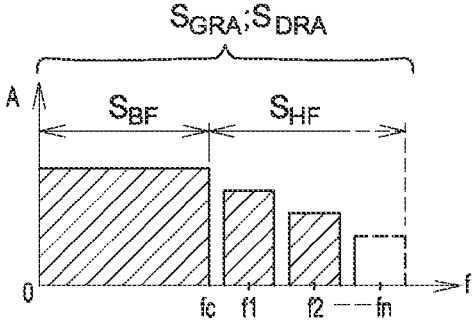

Then the high frequency part of the duplicated signal $S_D$ is isolated (without the isolated part Si from which it has been obtained) in order to obtain a high frequency component $S_{HF}$ of the sound signal shown in FIG. 7*d*. For this purpose, a band-pass filter 39 having a lower limit and an upper limit is used. In an example, the lower limit is equal to $f_C$ while the upper limit is equal to 20 kHz.

In addition, the restored left $S_{GR}$ (resp. right $S_{DR}$) sound signal is filtered by means of a low-pass filter 41 with a cut-off frequency substantially equal to $f_C$ to keep only the low frequency component $S_{BF}$ of the restored signal $S_{GR}$, $S_{DR}$. The low frequency part $S_{BF}$ is then delayed with a delay D4 by means of a delay cell 42. This delay D4 is about some samples.

Then, the low frequency component $S_{BF}$ is added to the high frequency component $S_{HF}$ by means of an adder 44, in order to obtain an increased restored left $S_{GRA}$ (resp. right $S_{DRA}$) sound signal formed of the initial low frequency component $S_{BF}$ of the restored sound signal and the high frequency component $S_{HF}$ thus generated by the method according to the invention.

Preferably, but that is not obligatory, a post-processing cell 45 modifies the form of the spectral response of the high frequency component $S_{HF}$, and gains g8 and g9 are applied to the high frequency $S_{HF}$ and low frequency $S_{BF}$ components before addition by means of the adder 44.

The parameters of the filters 36, 39, 41 depend on the compression ratio T. Indeed, the filters 36, 39, 41 have limits which depend on the cut-off frequency $f_C$. As this cut-off frequency $f_C$ depends on the compression ratio T, the limits also depend on the compression ratio T. There is thus a table 47 giving the correspondence between the compression ratio T and the associated filter parameters making it possible to generate the high frequency component of the left and right sound signals.

The parameters of the post-processing cell 45, of the non-linear processor 38, the delay cell 42, and the gains g8 and g9 also depend on the compression ratio T.

The parameters of the modules for generating treble frequencies 35 which process the left sound signal $S_{GR}$ and the right sound signal $S_{DR}$ are preferably symmetrical, i.e. the module 35 which processes the left sound signal $S_{GR}$ has parameters with the same value as the module 35 which processes the right sound signal $S_{DR}$.

The invention claimed is:

1. A method for encoding and decoding a digital audio signal composed of an original right sound signal and of an original left sound signal, comprising the steps of:

combining the original right sound signal and the original left sound signal, before encoding, by a pre-processing module to obtain a single combined signal;

encoding the single combined signal using an encoder to obtain a compressed combined signal;

decoding the compressed combined signal by a decoder to obtain a decompressed combined signal;

generating a restored right sound signal and a restored left sound signal from the decompressed combined signal after decoding, the restored right sound signal and the restored left sound signal de-correlated relative to one another corresponding respectively to the original right sound signal and to the original left sound signal;

adding a static meta-datum into a data frame encoded by the encoder, the static meta-datum indicating whether a pre-processing is activated or not, the static meta-datum having only two different values;

activating a post-processing module by the decoder when the decoder detects in an encoded frame a first value corresponding to activation of the pre-processing module; and inhibiting the post-processing module and decoding a stereo signal in right and left channels by the decoder when the decoder detects in the encoded frame a second value corresponding to the deactivation of the pre-processing module.

2. The method of 1, wherein the step of generating the restored right and left sound signals from the decompressed combined signal comprises the step of applying the decompressed combined signal to an input of a first and a second elementary blocks, output signals of the first and second elementary blocks corresponding respectively to the restored right sound signal and to the restored left sound signal; and wherein the output signal of each block of the first and second elementary blocks is a combination of an input signal of said each block weighted with a first gain, of the output signal of said each block weighted with a second gain, and of the input and output signals of said each block delayed by a delay line.

3. The method of claim 2, wherein the output signal ($s_1$) for the first elementary block corresponding to one of the right or left restored sound signal is defined by $s_1(n)=e_1(n)\cdot g_1+s_1(n-D1)\cdot g_2+e_1(n-D1)$, where $e_1$ being the input signal for the first elementary block corresponding to the decompressed combined signal, $g_1$ and $g_2$ being respectively the values of the first gain and the second gain of the first elementary block, n being $n^{th}$ harmonic sample, and D1 being the value of number of delay samples introduced by the delay line; and wherein the output signal ($s_2$) for the second elementary block corresponding to the other restored sound signal is defined by $s_2(n)=e_2(n)\cdot g_3+s_2(n-D2)\cdot g_4+e_2(n-D2)$, where $e_2$ being the input signal for the second elementary block corresponding to the decompressed combined signal, g3 and g4 being respectively the values of the first gain and the second gain of the second block, n being $n^{th}$ harmonic sample, and D2 being the value of number of delay samples introduced by the delay line.

4. The method of claim 2, wherein the gain values of the first and second gains of the first and second elementary blocks are opposite one another, the value of the first gain being opposite the value of the second gain.

5. The method of claim 2, wherein the gain values of the first and second gains of the first elementary block are opposite the gain values of the first and second gains of the second elementary block, the value of the first gain of the first elementary block being opposite the value of the first gain of the second elementary block and the value of the second gain of the first elementary block being opposite the value of the second gain of the second elementary block.

6. The method of claim 2, wherein the gain values of the first and second gains of the first and second elementary blocks have the same absolute value.

7. The method of claim 2, wherein the first gain of the first elementary block and the second gain of the second elementary block are equal to g; and wherein the second gain of the first elementary block and the first gain of the second elementary block are equal to −g.

8. The method of claim 2, wherein the delay introduced by the delay line of the first elementary block and the delay introduced by the delay line of the second elementary block are equal to one another.

9. The method of claim 2, further comprising the steps of filtering the decompressed combined signal with a high-pass filter to produce filtered high frequency and applying only the filtered high frequency part to the input of the first and second elementary blocks.

10. The method of claim 9, further comprising the steps of:

filtering the decompressed combined signal to produce a filtered low frequency part of the decompressed combined signal;

delaying the filtered low frequency part by a third delay line to produce a delayed low frequency part; and adding the delayed low frequency part to output signals obtained from the filtered high frequency part inputted to the first and second elementary blocks such that the restored right sound signal and the restored left sound signal are obtained.

11. The method of claim 2, further comprising the step of filtering the output signals of each elementary block by parametric filtering cells to modify sound perception of the output signals of the first and second elementary blocks.

12. The method of claim 1, further comprising, for each of the restored right and left sound signals, wherein each of the restored right and left sound signals are substantially formed of a low frequency component lower than a cut-off frequency, the steps of:

isolating a highest frequency part of said each of the restored right and left sound signals by a first band-pass filter;

duplicating, by a nonlinear processor, an isolated part with regard to a frequency by generating high frequency harmonics of an isolated signal to obtain a duplicated signal;

applying a second band-pass filter to the duplicated signal to obtain a high frequency component;

combining the high frequency component generated with said each of the restored right and left sound signals delayed by a delay cell to obtain an increased restored signal comprising a low frequency component and a regenerated high frequency component; and wherein upper and lower frequency limits of the band-pass filters depend on a compression ratio.

13. A digital stream encoder/decoder for encoding and decoding the digital audio signal composed of the original right sound signal and of the original left sound signal, comprising:

a pre-processor to combine, before encoding, the original right sound signal and the original left sound signal to obtain a single combined signal;

an encoder to encode the single combined signal to obtain a compressed combined digital signal and to add a static meta-datum into an encoded data frame, the static meta-datum indicating whether a pre-processor is activated or not, the static meta-datum having only two different values;

a decoder to decode a single compressed combined signal to obtain a decompressed combined signal;

a post-processor to generate, after decoding, from the decompressed combined signal, a restored right sound signal and a restored left sound signal de-correlated relative to one another corresponding respectively to the original right sound signal and to the original left sound signal; and wherein the decoder activates a post-processor upon detection of a first value corresponding to activation of the pre-processor in the encoded data frame, inhibits the post-processor and decodes a stereo signal in right and left channels upon detection of a second value corresponding to the deactivation of the pre-processor in the encoded data frame.

14. The digital stream encoder/decoder of claim 13, further comprises a module to generate treble frequencies, the module comprises:

a first band-pass filter to isolate a highest frequency part of each of the restored right and left sound signals;

a nonlinear processor to duplicate an isolated part with regard to a frequency by generating high frequency harmonics of an isolated signal to obtain a duplicated signal;

a second band-pass filter applied to the duplicated signal to obtain a high frequency component; and a combiner to combine the high frequency component with said each of the restored right and left sound signals delayed by a delay cell to obtain an increased restored signal comprising a low frequency component and a regenerated high frequency component.

* * * * *